US006537146B1

(12) United States Patent
Haynes

(10) Patent No.: US 6,537,146 B1
(45) Date of Patent: Mar. 25, 2003

(54) AIR REGISTER

(75) Inventor: Gerald D. Haynes, Elkhart, IN (US)

(73) Assignee: Continental Industries, Inc., Elkhart, IN (US)

( * ) Notice: Subject to any disclaimer, the term of this patent is extended or adjusted under 35 U.S.C. 154(b) by 0 days.

(21) Appl. No.: 10/010,174

(22) Filed: Nov. 13, 2001

(51) Int. Cl.[7] ..... F24F 13/15
(52) U.S. Cl. ..... 454/290; 454/325
(58) Field of Search ..... 454/290, 325, 454/335; 137/608.09

(56) References Cited

U.S. PATENT DOCUMENTS

| | | | | |
|---|---|---|---|---|
| 3,938,430 A | | 2/1976 | Koppang | |
| 4,014,253 A | | 3/1977 | Dry | |
| 4,417,687 A | | 11/1983 | Grant | |
| 4,876,951 A | | 10/1989 | Vork | |
| 4,907,500 A | * | 3/1990 | Brown | 454/290 |
| D309,347 S | | 7/1990 | Brown | |
| 5,312,298 A | | 5/1994 | Myers | |
| 5,588,911 A | | 12/1996 | Gomez | |
| 5,792,230 A | | 8/1998 | Moore et al. | |
| D413,665 S | | 9/1999 | Hudson | |
| 5,971,847 A | | 10/1999 | Webb | |
| 5,984,776 A | | 11/1999 | Berger | |
| 6,033,304 A | * | 3/2000 | Haynes | 454/290 |
| 2002/0022450 A1 | * | 2/2002 | Berger | 454/290 |

OTHER PUBLICATIONS

Set of photographs, 5 black and white pictures.
Set of photographs, 11 color pictures.

* cited by examiner

*Primary Examiner*—Harold Joyce
(74) *Attorney, Agent, or Firm*—Baker & Daniels

(57) ABSTRACT

A register for regulating the passage of air to be mounted in a vent opening of a wall, floor, or ceiling. The register includes a grill having a plate with grill openings for the passage of air therethrough, a frame connected to the bottom of the grill, at least one damper for regulating the air flow through the register, a pivotal connection connecting the dampers to the frame to allow pivotal movement there between, a biasing mechanism urging the damper against the frame to reduce rattling and vibrations there between, and a control mechanism for moving the damper between an open position permitting air to flow through the register and a closed position wherein air is inhibited from flowing through the register. The control mechanism includes a lever and a control bar. The biasing mechanism includes springs mounted to the control bar and pivotally connected to the damper wherein there is one spring individually urging each damper The leyer and control bar each move through a separate arc. when moving the damper between the open and closed positions.

22 Claims, 6 Drawing Sheets

AIR REGISTER

BACKGROUND

The present invention relates to a register for controlling air flow into a room from an air duct in a floor, wall or ceiling and, in particular, to a register which has at least one damper that is urged by a biasing mechanism reducing vibrations and rattling while permitting a smooth operation of a control mechanism.

It has become well known to use air registers to control the flow of heated, cooled or vented air from a duct system into a room. The register is commonly mounted within a duct opening of the duct system and typically includes fixed or adjustable grill openings or louvers on a grill or face plate of the register. Mounted to the grill is a register frame or body which extends into the duct and helps secure the register thereto and directs airflow through to the face plate. The registers usually employ one or more adjustable dampers within the register body to control the direction and volume of air flow. The dampers can typically be moved between a closed position to block airflow through the register, a partially opened position, and a fully opened position to maximize airflow therethrough.

It has been known to provide either a manual mechanism for adjusting the dampers or motorized dampers as is found in U.S. Pat. No. 4,417,687 to W. Grant and U.S. Pat. No. 5,588,911 to R. Gomez, both of which are incorporated herein by reference. Although the embodiments depicted in the present invention are directed primarily to a manually operated damper control mechanism, it should also be appreciated that the features herein may also be useable with a motorized damper control as taught in these patents or is otherwise known in the art.

An example of a manual prior art control mechanism for dampers is found in U.S. Pat. No. 4,907,500 to D. Brown, incorporated herein by reference. In the register disclosed by Brown, the dampers are moved by pivoting a lever, which is pivotally connected to a control or connecting bar. The control bar in turn is connected to the dampers by pins or rivets.

Another air register and control mechanism is disclosed in U.S. Pat. No. 4,876,951 to D. York, herein incorporated by reference. The register in York has a sliding control lever. The control lever has arcuate slot for receiving a pintle on a control bar or connecting link. The dampers or louvers are pivotally connected to apertures on the control bar. As the lever is slid, the pintle slides in the arcuate slot and the control bar is translated laterally thereby adjusting the dampers.

One of the drawbacks to the prior art registers is that the prior connections between the dampers and the control bar or frame of the register tend to vibrate and rattle as air flows through the register or other vibratory energy is imparted on the register. In addition, many control mechanisms are stiff or difficult to move in order to adjust the position of the dampers.

Therefore, it is an object of the invention to provide a register wherein the dampers are resistant to rattling. It is another object of the invention that the resistance to rattling is accomplished by a biasing mechanism including at least one spring to firmly hold the dampers in the register body. Another object of the invention is that there be one spring for each damper wherein the springs are on a control bar of a control mechanism. It is also an object of the invention to provide a register with dampers that move smoothly between the open and closed positions and will remain in the position set until moved.

SUMMARY OF THE INVENTION

The objects of the invention have been accomplished by providing a register for regulating the passage of air to be mounted in a vent opening of a wall, floor, or ceiling. The register includes a grill having a plate with grill openings for the passage of air therethrough, a frame connected to the bottom of the grill, at least one damper for regulating and directing the air flow through the register, a pivotal connection connecting the damper to the frame to allow pivotal movement there between, a biasing mechanism for pushing on the damper to reduce rattling from vibrations between the damper and frame, and a control mechanism for moving the damper between an open position permitting air to flow through the register, and a closed position wherein air is inhibited from flowing through the register.

It is another feature of the invention that the biasing mechanism is connected to the control mechanism. The biasing mechanism includes at least one leaf spring attached to the control mechanism.

Another aspect of the invention is that in the preferred embodiment the control mechanism includes a lever and a control bar, the control bar transfers movement from the lever to the damper.

Also, it is a feature of the invention that the control bar has a butterfly aperture and the lever is pivotally connected to the control bar at the butterfly aperture. The butterfly aperture has a reduced central section that limits movement of the lever.

A further feature of the invention is that the frame includes an aperture and an arcuate slot and the lever is pivotally connected to the aperture. Also, the lever has an offset portion, and the offset portion extends through the arcuate slot.

Another aspect of the invention is that the biasing mechanism is pivotally connected to the damper at an extension portion thereof.

An additional feature of the invention is that the leaf springs have fingers which extend into apertures of the extension portions of the damper to pivotally connect the damper and the biasing mechanism.

It is also an aspect of the invention that the register may include more than one damper and said biasing mechanism includes a separate spring for each damper. In the preferred emodiment the springs are mounted on the control bar.

Additionally, it is a feature of the invention that the control bar and the lever each move through an arc as the damper is moved between the open and closed positions. The arc of the control bar is different than the arc the lever travels through.

DETAILED DESCRIPTION OF THE PREFERRED EMBODIMENT

An air register for mounting in a vent opening of a wall, floor or ceiling for regulating the passage of air from an air duct is generally indicated as 10. Air register 10 includes a grill or face plate generally indicated as 12, a frame or body generally indicated as 14, dampers or louvers 16, and a control mechanism generally indicated as 18 for moving the dampers between an open position allowing air to flow through the register and out the grill and a closed position where air is inhibited from flowing through the register.

Figure 1:
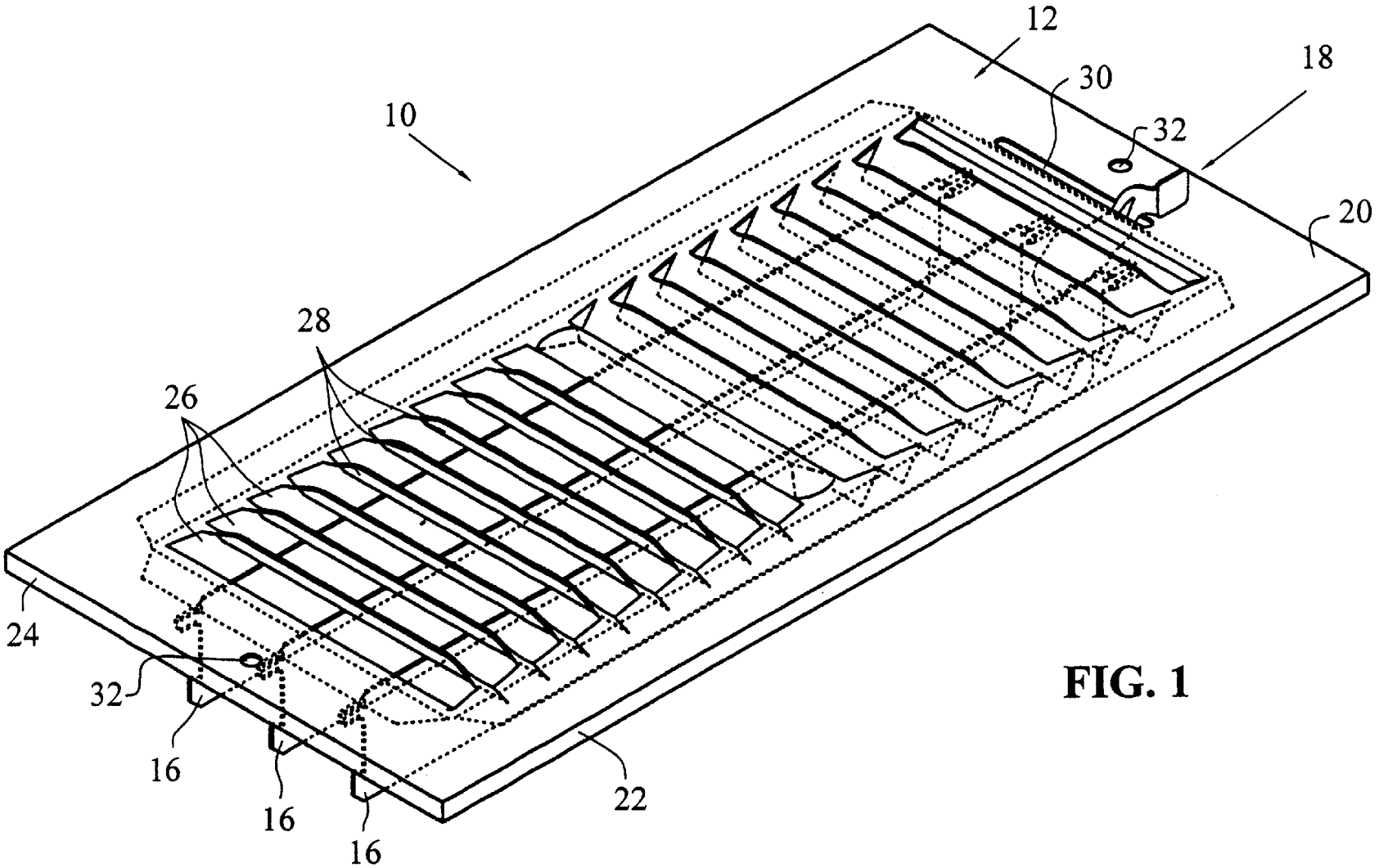
FIG. 1 is a perspective view from the top side of the grill plate and incorporating the subject invention.
Figure 3:
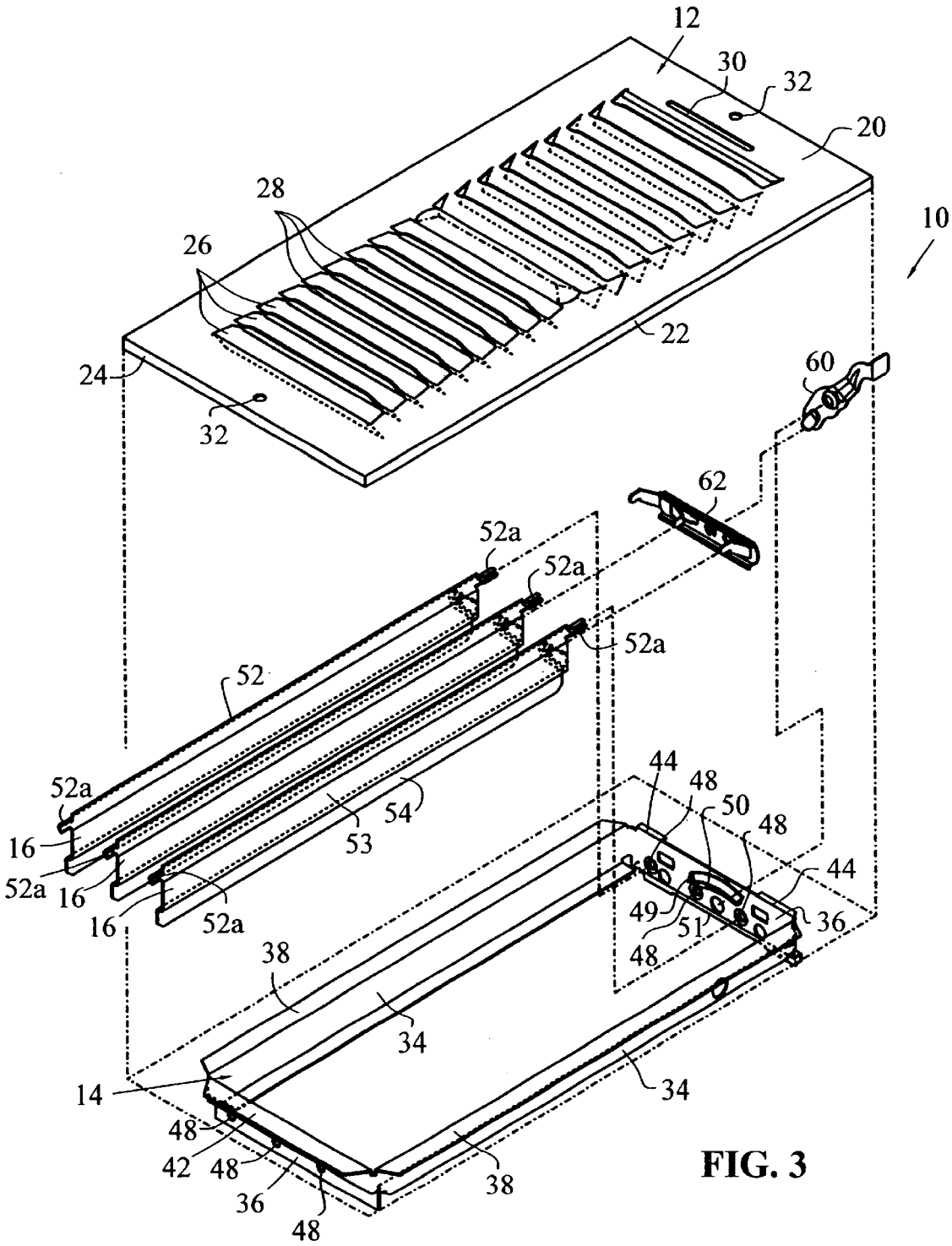
FIG. 3 is an exploded perspective view of a register having the subject invention.

As best seen in FIGS. 1 and 3, grill 12 includes a generally planer surface 20, side edges 22, and end edges 24. Located on planer surface 20 are grill openings 26 to allow air to pass from a duct (not shown) through register 10 into a room (not shown). Between grill openings 26 are fins or vanes 28 to direct air flow. Towards one end of planer surface 20 is an elongated slot 30 for accommodating a portion of control mechanism 18. At opposite ends of planer surface 20 adjacent end edges 24 are mounting apertures 32 for mounting register 10 in the duct.

Figure 2:
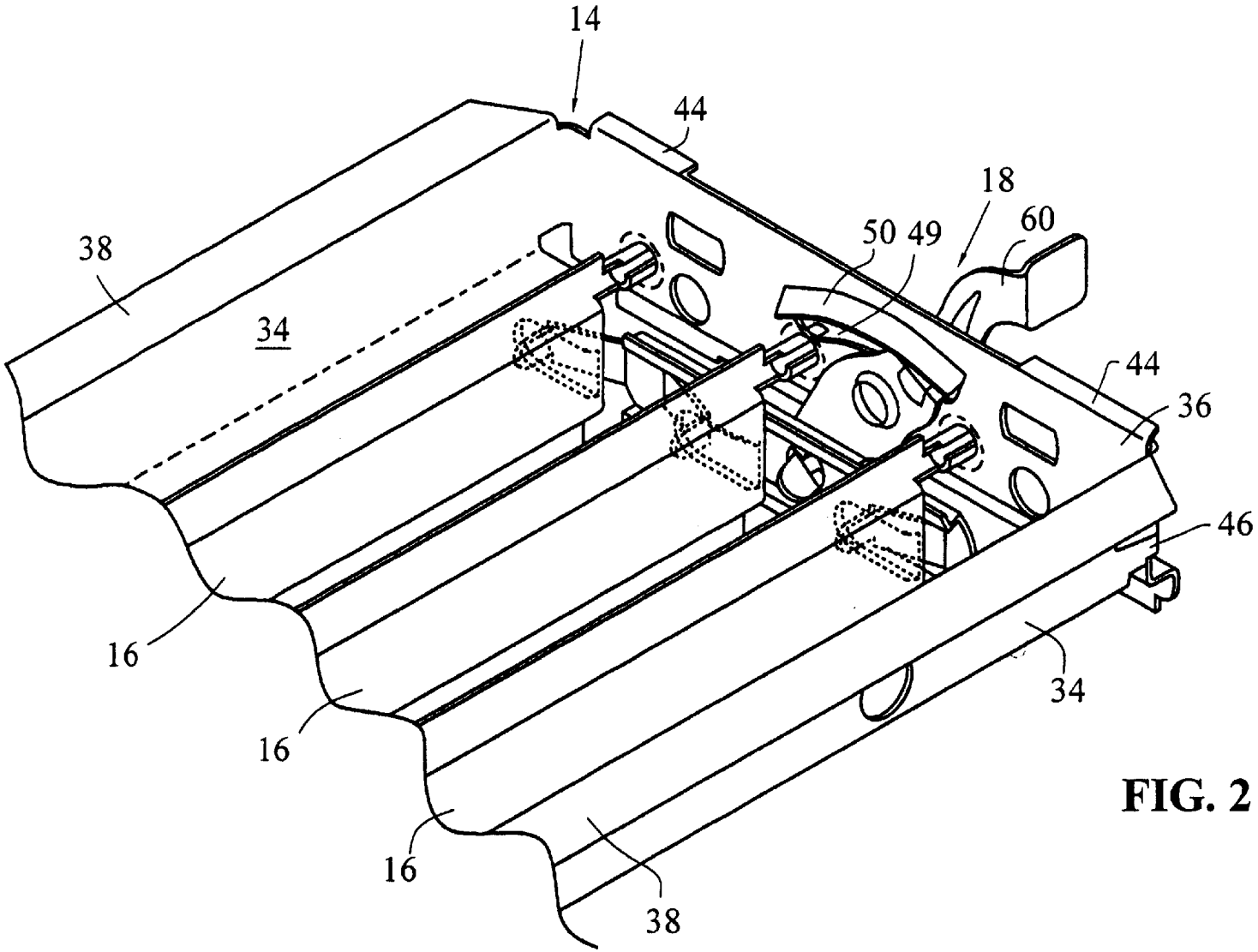
FIG. 2 is an enlarged perspective view from the topside of the register wherein the grill plate has been removed.
Figure 4:
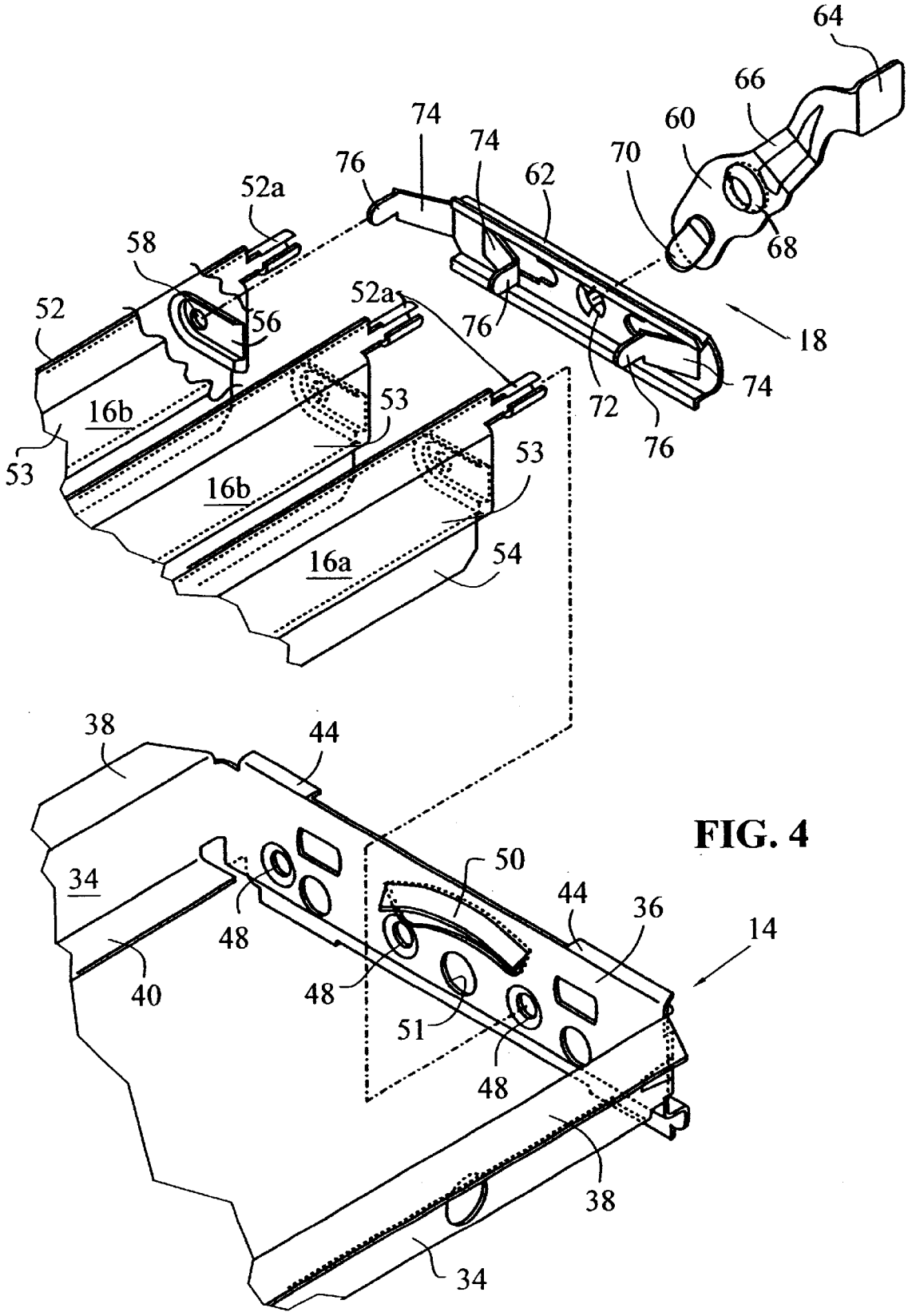
FIG. 4 is an enlarged exploded view of the control mechanism for a register of the subject invention.
Figure 5:
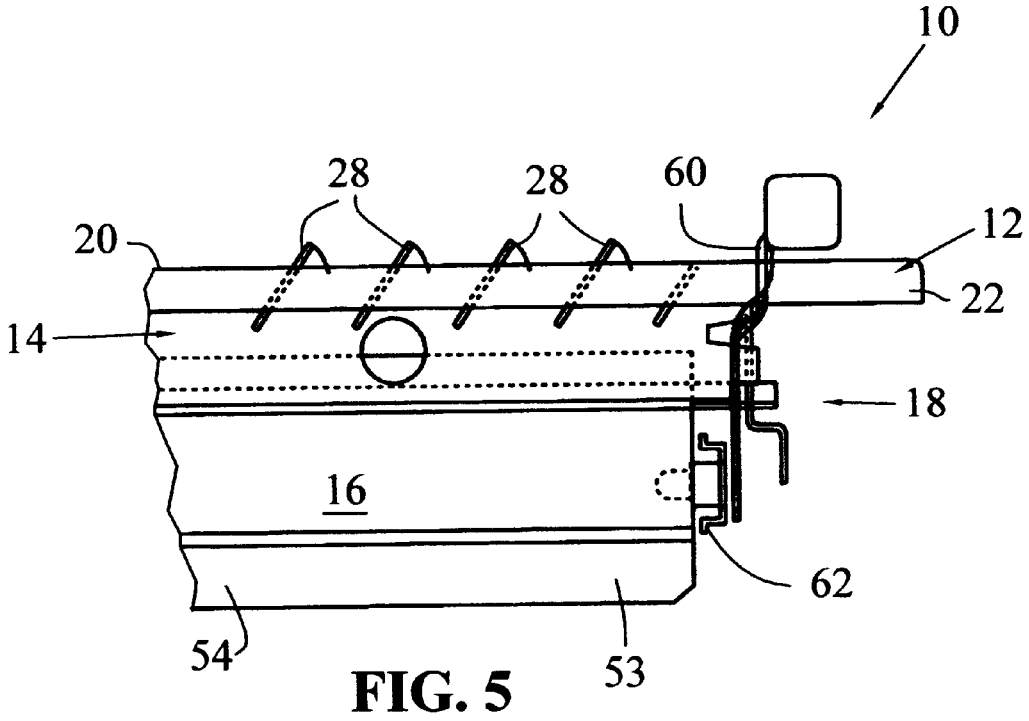
FIG. 5 is a side view of the register showing the control mechanism.
Figure 7:
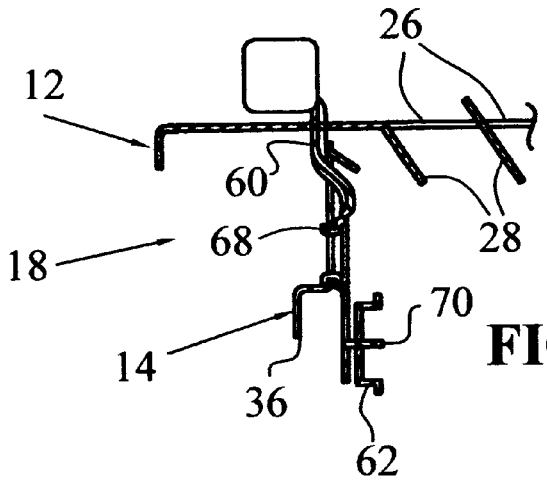
FIG. 7 is a cross-sectional view taken through the control mechanism.

Frame 14 has a generally rectangular shape as is best seen in FIGS. 2—4 and includes two generally parallel side portions 34 and two generally parallel end portions 36 which are orthogonal to side portions 34. Side portions 34 have upper outwardly extending flanges 38 and lower inwardly extending flanges 40. One of end portions 36 has an upper outwardly extending flange 42 and the other end portion 36 has a pair of tabs 44 at the upper end thereof. In one corner of frame 14 joining one side portion 34 to one end portion 36 is a crimped connection 46. On each end portion 36 are damper receiving apertures 48. In the preferred embodiment, there is one aperture 48 on each end portion 36 for every damper 16 of register 10. Also, in one of end portions 36 is an arcuate slot 49, which is partially shrouded by a flared lip 50, and a lever receiving aperture 51. The arcuate slot 49 receives a portion of the control mechanism 18 as will be more fully described herein below.

Referring to FIGS. 2 and 3, it can be seen that the dampers are generally referred to as 16 and that individual dampers are identified as 16*a,* 16*b,* and 16*c* in FIG. 4. The dampers include integrally formed rounded ribs 52 extending along the length thereof. Rounded ribs 52 provide structural stability to the dampers and also serve as a seating/sealing surface when the dampers are closed as will be described more fully below. At both ends of the dampers, rounded ribs 52 extend outwardly beyond the edge of the damper to form integral axle portions 52*a*. Dampers 16 also include main body portions 53, lower offset portions 54, and integral pivot extensions 56, which each have a pivot aperture 58 therein. The main body portions 53 are generally parallel to offset portions 54 as can best be seen in FIG. 6.

Control mechanism 18 includes a lever 60 and a control bar 62 as best shown in FIG. 4. Lever 60 includes a handle portion 64, an offset portion 66, a boss 68 and a tab 70. The control bar 62 includes a butterfly aperture 72 having a reduced central portion 73 and integrally formed biasing means/leaf springs 74, which each have a projecting finger 76 thereon.

Having outlined the component parts of air register 10, the manufacturing and assembling thereof will be discussed in further detail. In the preferred embodiment, grill 12 is stamped and formed from a piece of sheet metal as is well known in the art.

Frame 14 is also stamped and formed from sheet metal wherein three of the corners between side portions 34 and end portions 36 consist of bends in the sheet. The ends of the frame sheet are joined together with a crimped connection 46 to form the remaining corner. Dampers 16, which are also stamped and formed from sheet metal, are mounted to frame 14 by inserting integral axle portions 52*a* into damper receiving apertures 48 and flaring the ends of axle portions 52*a* outward to retain the dampers within the receiving apertures.

In the preferred embodiment, lever 60 and control bar 62 of control mechanism 18 are also formed from stamped metal. Lever 60 is inserted through elongated slot 30 of grill 12 so that the handle portion 64 is above planer surface 20. Offset portion 66 is extended through arcuate slot 49 in end portion 36 of frame 14 so that the lower end of lever 60 is located towards the interior of the frame. Boss 68 is positioned within lever receiving aperture 51 and flared outwardly to connect the lever to the frame and allow pivotal movement of the lever about receiving aperture 51.

The control bar 62 is positioned so that tab 70 of lever 60 extends within butterfly aperture 72. The control bar 62 is connected to the dampers 16 by inserting each projecting finger 76 on leaf springs 74 into the respective pivot aperture 58 of pivot extensions 56.

Frame 14 is attached to grill 12 by spot welding the upper outwardly extending flanges 38 to the side opposite planer surface 20. Of course, other attachment means which are well known in the art such as seam welding, arc welding, studs, rivets or bolts may also be used to attach the frame to the grill. The register can then be mounted to the duct for use with screws or bolts (not shown) through mounting aperture 32 in grill 12.

Figure 6:
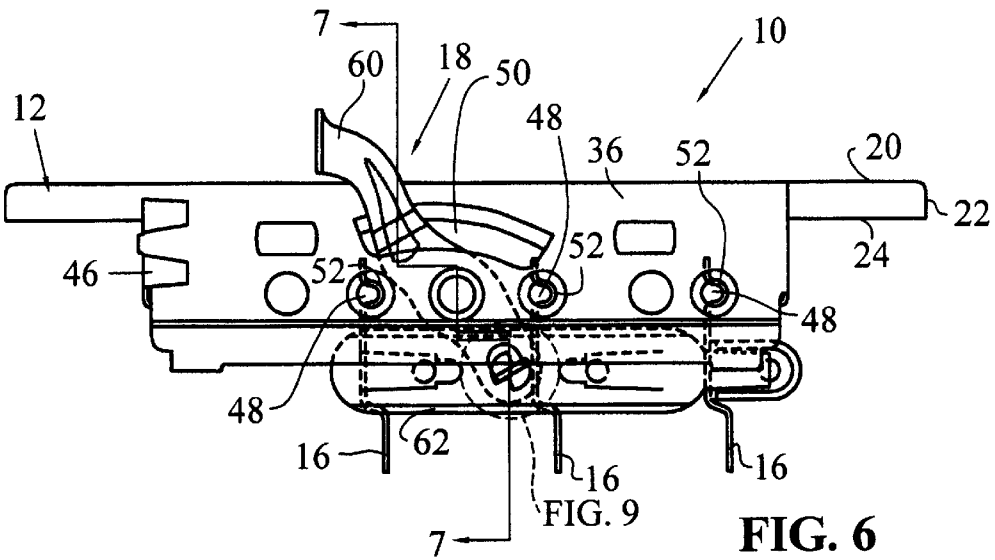
FIG. 6 is an end view of the register showing the control mechanism with the dampers in the open position.

The operation of air register 10 is designed such that dampers 16 may be moved from an open position allowing air to flow from the duct and out of grill 12 into the room to a closed position wherein air is inhibited from flowing through the register. In the open position, dampers 16 lie in generally parallel planes being substantially perpendicular to planer surface 20 of grill 12 as is best seen in FIG. 6. In the closed position, the main body portions 53 of damper 16 lie in a common plane that is substantially parallel to planer surface 20 as shown by the phantom lines in FIG. 8. In the open position, air freely flows between the dampers and out of grill 12, while in the closed position, the dampers form a wall to inhibit air flow therethrough. Offset portions 54 enhance the ability of the dampers to inhibit air flow in the closed position by providing a tighter fit. When closed, the offset portion 54 on damper 16*a* engages the bottom side of one of the lower inwardly extending flanges 40 of one side portion 34 and the offset portions of dampers 16*b,* 16*c* engage the rounded rib of the adjacent damper (i.e. offset portion 54 of damper 16*b* engages the rounded rib 52 of damper 16*a* and the offset portion 54 of damper 16*c* engages the rounded rib 52 of damper 16*b*).

Figure 9:
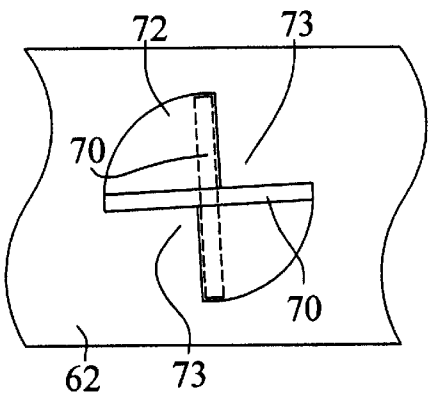
FIG. 9 is a close up view of a butterfly aperture in a control bar of the control mechanism having a tab of a control lever therein as shown from the inside of the control bar.
Figure 8:
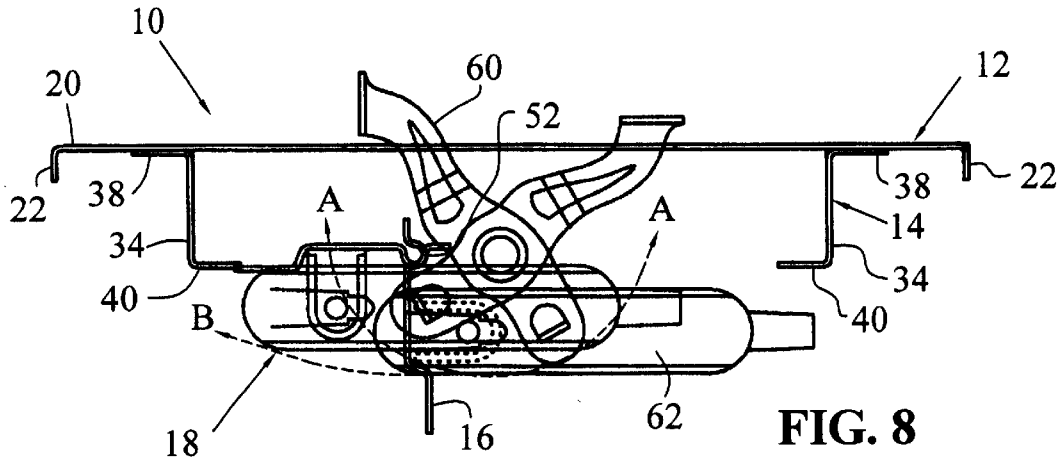
FIG. 8 is another end view of the register showing the control mechanism in solid lines when the dampers are in the open position and in phantom lines when the dampers are in the closed position.

Moving the dampers between the opened and closed position is accomplished by means of the control mechanism 18. To change the positioning of the dampers, the user grabs and pushes handle portion 64 of lever 60 thereby pivoting the lever about the lever receiving aperture 51 relative to frame 14 so that the bottom of the lever moves in an arc A. This in turn moves control bar 62 as it is connected to lever 60 by tab 70, which is inserted into butterfly aperture 72. As the tab can partially rotate within butterfly aperture 72 (FIG. 9), the lever pushes the control bar through an arc B which is defined by the movement of the pivot extensions 56 which are pivotally connected to the control bar 62 by leaf springs 74. Movement of the lever and control bar is limited by the narrowed central portion 73 of butterfly aperture 72, which comes into contact with tab 70 as the lever is pivoted as best shown in FIG. 9. Of course, the dampers rotate within the damper receiving apertures 48, and projecting fingers 76 rotate relative to the pivot apertures 58 in the damper extensions 56 as the lever is being moved. As seen in FIG. 8, the arc B that the control bar travels in is therefore different than the arc A that the lever travels in thereby preventing binding of the mechanism as should be apparent to one skilled in the art.

It should be appreciated, that the leaf springs 74 which are attached to and integral with the control bar 62 provide a constant force against the pivot extensions 56 of dampers 16 to inhibit vibrating and rattling of the dampers. This is because the springs push the dampers against the opposite end portion 36 of frame 14 which eliminates play in the pivot connections between axle portions 52*a* of dampers 16 and damper receiving apertures 48. An additional feature of the invention is that the dampers are each biased individually by a separate leaf spring 74 which is believed to be more effective than biasing the dampers as a group.

It should also be appreciated, that the dampers may be moved to a position intermediate the open and closed positions to somewhat restrict air flow through the register and/or to provide directional control of the air flow. The leaf springs assist in maintaining the dampers in such an intermediate position without rattling and without the dampers falling to an open position, yet the unique design still enables free and easy movement of the lever for positional changes of the dampers.

While the invention has been taught with specific reference to the embodiment in the drawings, someone skilled in the art will recognize that changes can be made in form and detail without departing from the spirit and scope of the invention. For example, although fins 28 in grill 12 have been depicted as the fixed type, moveable fins which are known in the art may also be incorporated for enhanced control of the direction of air flow. Also, other materials and/or manufacturing processes may be utilized for manufacturing the air register. For instance, injection molded plastics or castings may be suitable. Moreover, although the air register depicted utilizes three dampers, the invention may be used on a register with more or less dampers. In addition, although the dampers in the preferred embodiment utilize cost efficient integrally formed axles, the dampers may also be made with separate axles connected to the dampers and rotationally mounted in the damper receiving apertures. Furthermore, the apertures may be replaced by pins mounted to frame and inserted into the axle portions or the dampers may be otherwise pivotally connected to the frame. It is also possible to utilize other types of spring members, such as coil springs, instead of the leaf springs used in the preferred embodiment. The scope of the invention is, therefore, indicated by the attached claims rather than by the description.

What is claimed is:

1. A register to be mounted in a vent opening of a wall, floor, or ceiling for regulating the passage of air, comprising a grill including a plate having grill openings for directing the passage of air therethrough, a frame connected to the bottom of the grill, said frame including an arcuate slot that is bowed with the inside of the bow facing away from the grill from said grill, at least one damper for regulating the air flow through the register, a pivotal connection connecting said dampers to said frame to allow pivotal movement there between, a biasing mechanism for biasing said damper toward said frame, and a control mechanism for moving said damper between an open position permitting air to flow through said register and a closed position wherein air is inhibited from flowing through said register.

2. The register as set forth in claim 1 wherein said biasing mechanism is connected to said control mechanism.

3. The register as set forth in claim 2 wherein said control mechanism includes a lever and a control bar, said control bar transferring movement from said lever to said damper.

4. The register as set forth in claim 3 wherein said biasing mechanism includes leaf springs attached to said control bar.

5. The register as set forth in claim 3 wherein said control bar has a butterfly aperture and said lever is pivotally connected to said control bar at said butterfly aperture.

6. The register as set forth in claim 3 wherein said frame includes an aperture and said lever is pivotally connected to said aperture.

7. The register as set forth in claim 6 wherein said lever has an offset portion extending through said arcuate slot.

8. The register as set forth in claim 1, having a plurality of dampers and said biasing mechanism includes a separate spring for each damper, said springs mounted on a control bar of said control mechanism.

9. A register as set forth in claim 3 wherein both the control bar and the lever each move through an arc as the dampers move between the open and closed positions, said arc of said control bar being different than said arc of said lever.

10. A register to be mounted in a vent opening of a wall, floor, or ceiling for regulating the passage of air, comprising a grill including a plate having grill openings for directing the passage of air therethrough, a frame connected to the bottom of the grill, at least one damper for regulating the air flow through the register, a pivotal connection connecting said dampers to said frame to allow pivotal movement there between, a biasing mechanism for biasing said damper toward said frame, and a control mechanism for moving said damper between an open position permitting air to flow through said register and a closed position wherein air is inhibited from flowing through said register, said control mechanism including a handle portion and a control bar, said control bar and said handle portion being located on opposite sides of an end wall of said frame, and said biasing mechanism being pivotally connected to said damper.

11. The register as set forth in claim 10 wherein said damper has an extension portion and said biasing mechanism is pivotally connected to said damper at said extension portion.

12. The register as set forth in claim 11 wherein said biasing mechanism includes a leaf spring, said leaf spring having a finger that extends into an aperture of said extension portion to pivotally connect said damper and said biasing mechanism.

13. A register to be mounted in a vent opening of a wall, floor, or ceiling for regulating the passage of air, comprising a grill including a plate, having vanes for directing the passage of air therethrough, a frame connected to the bottom of the grill, at least one damper for regulating the air flow through the register, said damper being pivotally connected to said frame to allow pivotal movement therebetween, and a control mechanism for moving said damper between an open position permitting air to flow through said register, and a closed position wherein air is inhibited from flowing through said register, said control mechanism including a lever and a control bar for translating movement from said lever to said damper, said control bar having a butterfly aperture, said lever being pivotally connected to said control bar at said butterfly aperture, and the configuration of said butterfly aperture limiting movement of said lever.

14. The register as set forth in claim 13 wherein the frame includes an aperture and said lever is also pivotally connected to said aperture in said frame.

15. The register as set forth in claim 14 wherein the lever has an offset portion and said offset portion extends through an arcuate slot in said frame.

16. The register as set forth in claim 13 further comprising a biasing mechanism to urge said damper toward said frame.

17. The register as set forth in claim 16 wherein the biasing mechanism includes at least one spring member attached to said control bar.

18. The register as set forth in claim 17 wherein the spring member is a leaf spring, and said leaf spring bears against an extension portion of said damper.

19. The register as set forth in claim 13 wherein the damper has axle portions at opposite ends thereof, said axle portions extending into damper openings on opposite ends of said frame to form said pivotal connection.

20. The register as set forth claim 16 having a plurality of dampers and said biasing mechanism includes a separate spring for each damper, said springs mounted on a control bar of said control mechanism.

21. A register as set forth in claim 13 both the control bar and the lever each move through an arc as the dampers move between the open and closed positions, said arc of said control bar being different than said arc of said lever.

22. A register to be mounted in a vent opening of a wall, floor, or ceiling for regulating the passage of air, comprising a grill including a plate, having vanes for directing the passage of air therethrough, a frame connected to the bottom of the grill, at least one damper for regulating the air flow through the register, a pivotal connection connecting said damper to said frame to allow pivotal movement therebetween, a biasing mechanism for urging said damper towards said frame, and a control mechanism for moving said damper between an open position permitting air to flow through said register, and a closed position wherein air is inhibited from flowing through said register, said control mechanism including a lever with a handle portion and a control bar, said control bar and said handle portion being located on opposite sides of an end wall of said frame, said biasing mechanism including at least one spring member mounted on said control bar, said spring mechanism bearing against an extension portion of said damper, and said spring mechanism having a finger received in an aperture of said extension portion.

* * * * *